United States Patent [19]

Knudson et al.

[11] Patent Number: 5,032,146

[45] Date of Patent: Jul. 16, 1991

[54] LOW-RANK COAL OIL AGGLOMERATION

[75] Inventors: Curtis L. Knudson; Ronald C. Timpe, both of Grand Forks, N. Dak.

[73] Assignee: The University of North Dakota School of Engineering & Mines Foundation (UNDSEM Foundation), Grand Forks, N. Dak.

[21] Appl. No.: 414,536

[22] Filed: Sep. 28, 1989

[51] Int. Cl.[5] ..... C10L 5/02

[52] U.S. Cl. ..... 44/592; 44/608; 44/626; 44/627

[58] Field of Search ..... 44/592, 24, 502, 620, 44/608, 626, 627

[56] References Cited

U.S. PATENT DOCUMENTS 4,282,004 8/1981 Masologites ..... 44/626
4,284,413 8/1981 Capes et al. ..... 44/626
4,726,810 2/1988 Ignasiak ..... 44/24
4,854,940 8/1989 Janiak et al. ..... 44/627

OTHER PUBLICATIONS

Szladow and Chan, "Kinetics of Heavy Oil/Coal Co-processing," *Energy & Fuels* 1989, 3, only p. 136.

Ikura et al., "Selective Oil Agglomeration of Lignite Using Vacuum Bottoms Only as an Integral Part of Coprocessing," *Energy & Fuels,* 1989, 3, 132–136.

*Primary Examiner*—Margaret B. Medley

*Attorney, Agent, or Firm*—Zarley, McKee, Thomte, Voorhees, & Sease

[57] ABSTRACT

A low-rank coal oil agglomeration process. High mineral content, a high ash content subbituminous coals are effectively agglomerated with a bridging oil which is partially water soluble and capable of entering the pore structure, and usually coal derived.

10 Claims, No Drawings

LOW-RANK COAL OIL AGGLOMERATION

GRANT REFERENCE

This invention was made with the government support under contract No. DEFC21-86MC10637, awarded by the Department of Energy. The government has certain rights in this invention.

BACKGROUND OF THE INVENTION

Research into the oil agglomeration of bituminous coals as a means of beneficiation has been very successful. However, transfer of this technology to low-rank coals has proven difficult. Put another way, low-rank coals, that is coals which contain inherent and particulate ash and are high in moisture content are very difficult to agglomerate. This is important because much of the available coal resources in this country are surface mined lignite and subbituminous (low-rank) coals. These are particularly known to be high in organic salt content and high in mineral content, high moisture, and some are high in sulfur. They also burn less efficiently, and may cause ash fowling of boilers and may cause more undesirable emissions.

Nevertheless, the dwindling petroleum reserves and OPEC control of the petroleum economy in the past two decades has rekindled interest, worldwide, in coal as a source of energy. The return to emphasis on coal utilization after several decades of a petroleum energy base has begun to impact the world's supply of high quality, easily mined, low-ash coal. Mineral matter (including organic salts), and sulfur and water content are three of the major concerns with the increased use of coal as a utility fuel or as a feedstock for conversion processes. Their presence in the coal impacts ash handling and disposal, $SO_x$ and $NO_x$ emissions, fly ash and ash fouling, calorific value of the fuel, transportation costs, and the reactivity of the feedstock. Substantial upgrading of the coal would result from its demineralization and dewatering. Finding new, more efficient methods of beneficiation of coals has therefore become a priority in coal research.

Among the most widely used methods of fine coal beneficiation at present is froth flotation. Although the technique works quite well with higher rank coals and fines with larger particle sizes and low ash, it does have some drawbacks. Among its shortcomings are a comparatively low yield of beneficiated product with a high moisture content when fines are less than 6 μm. As mined, coals and coals with oxidized surfaces are not amenable to beneficiation by flotation.

Agglomeration studies of lignite and subbituminous (lowrank) coals have not met with a great deal of success primarily because the experiments have centered around the successful techniques used to agglomerate bituminous coal. Since agglomeration is a surface phenomenon, the binding oil selected to form the aggregates of fines must be compatible with the surface functional groups on the fines. Subbituminous and lignite coals contain large amounts of surface oxygen organic salts, minerals and water making their surfaces less oleophilic than the surfaces of bituminous coals.

Most oils used for agglomeration are not highly polar and as a result are readily adsorbed to the organic surface of the coal particles, provided they have minimal surface polar groups and surface water. These characteristics apply to bituminous coals but not to lower rank coals. Since the theory of agglomeration assumes mineral material is considerably more hydrophilic and olephobic than the organic coal matrix, the mineral material will dissolve or form a suspension in an aqueous medium and the organic matter, upon mixing with a limited amount of oil, will form aggregates and separate from that phase. Again, this is more easily accomplished with aliphatic binding oils for the coals of higher rank than for those of lower rank.

It can therefore be seen that there is a continuing and real need for the development of coal beneficiation processes which can be used with low-rank coal. Moreover, there is a continuing need for processes which are cost effective, provide agglomerates which are nonpolluting, and which in fact beneficiate the low-rank coal.

The process of the present invention has as its primary objective the fulfillment of the above need. In particular, the development of an economical low-rank coal beneficiation process, which can be successfully performed and which will reduce the polluting effect of the coal, as well as the salt content, mineral content and moisture content, such that it can be more efficiently used.

Another object of the present invention is to develop a coal beneficiation process which is successful for low-rank coals and which uses only coal-derived oil for agglomeration.

Another object of the present invention is to develop a coal beneficiation process which does not necessarily need use of added surfactants in the agglomeration process.

Another objective of the present invention is to provide low-rank coal agglomerates which are deashed and dewatered.

The method and manner of accomplishing each of the above objective will become apparent from the detailed description of the invention which follows hereinafter.

SUMMARY OF THE INVENTION

In accordance with the process of this invention, lignite and/or subbituminous coals are size-reduced, the pH is adjusted to five or less, the particles are thereafter mixed with from about 20% by weight to about 50% by weight of a bridging oil which is at least partially water soluble and capable of entering the pore structure of the coal, and which is preferably derived from coal itself. The oil and the particles are blended, mixed, agglomerated, and thereafter dried.

DETAILED DESCRIPTION OF THE INVENTION

To meet the requirements of successful agglomeration, the mineral content of a coal should be reduced significantly as the coal forms aggregates of organic-rich material, while additional ash removal occurs by removal of salts by ion exchange. The degree to which a coal can be beneficiated by agglomeration is limited by several factors. The first is the particle size. Liberation of minerals depends largely on their surface exposure to liberating media. The effect that particle size has on the liberation is easily understood when one considers the mode of emplacement of minerals into the coal. Mineral particles, which are typically nonuniform in size and widely dispersed in the coal, were incorporated into the organic matrix by one or more of three methods: (1) Minerals inherent to the living vegetation were laid down with the organic plant material as it ended its life cycle; (2) Detrital material was entrapped as the generations off original plant material accumulated; and, (3) Chemical solutions deposited mineral material from saturated water solutions. In addition, organic salts are present in the coal which can ion exchange with ions in surrounding water.

The lower the pH the more salts are removed by ion exchange. The finer the particle size, the more contact that can occur between the liquid and the widely dispersed minerals, and, consequently, the better the chances of the carbonaceous material liberating its associated minerals, thus lowering ash content. Although fine grinding enhances inorganics removal, it may create problems in handling the cleaned product and provides more area for undesirable surface oxidation. Effective agglomeration following ash reduction helps to solve these problems.

A second factor to be considered is the composition of the oil used as a binder. Light agglomerating oils (density <0.90 g/cc) have been shown to give ash reductions in bituminous coals within 10 to 20 percent of those obtained with Stoddard solvent. These oils, however, do not wet the surface of low-rank coals well, and are not useful as binding oils for these coals. If heavier oils such as coke oven tars, pitches, and petroleum crudes are used, low-rank coals can be agglomerated, but with little ash and moisture reduction and the recovery of these oils from agglomerates requires rigorous treatment, which translates to added cost.

In accordance with the process of this invention in a first step, the coal particles of the low-rank coal are size reduced. In the size reduction step, particles should be size reduced such that they will pass through a 60 mesh standard U.S. sieve screen (combustion grind) where standard size reduction techniques may be employed such as a standard hammer mill. If desired, the particles may be ground to a micro grind size of from about 10 to about 20 microns with special equipment.

After size reduction, in accordance with the process of this invention it has been found necessary to adjust the pH of the size reduced particles to 5 or less, and preferably to 3 or less. The pH adjustment may be with any useful acid such as sulfuric acid, hydrochloric acid, nitric acid, and even carbonic acid. The importance of the pH adjustment is to allow removal of carboxylic acid salts with the mineral phase, especially sodium salts of carboxylic acids.

Most preferably the pH is adjusted to 5 or less, preferably 3 or less, and best results are seen at highly acid pH conditions of 1. The lower the pH the more efficiently sodium ions ($Na+$) and calcium ions ($Ca++$) are removed.

After the pH adjusting acid is added, usually in an aqueous system, the coal/acid slurry is mixed, at from about 100 rpms to about 1500 rpms on a conventional mixer, for anywhere from 10 minutes to about 30 minutes.

After the pH reduction, the particles are mixed with from about 20% by weight t about 50% by weight of the bridging oil. The bridging oil must be a polar organic solvent which is at least partially water soluble and capable of entering the coal pore structure. Usually, and in most cases preferably, the bridging oil itself is coal-derived. It can be successfully derived from coal gasification plants and coal pyrolysis processing. In coal gasification plants two of the oil streams which can be used to provide the most highly preferred coal-derived bridging oil are the crude phenolic stream and the crude coal tar stream. The phenolic stream can be the crude phenolic stream which has a predominate amount of phenol and creosol present. Likewise, the crude coal tar derived stream has a predominant amount of creosol and polar aromatics are present. There is also present a certain amount of cresylic acid in the creosol tar stream which functions as a surfactant, coating the coal surface and entering the coal structure to expel water from the pores. The oil or hydrophobic portion of the bridging oil accumulates on the surface and bridges to other coal particles. As a result, the bridging oil of this invention is far superior to the oils used in conventional oil agglomeration processing such as petroleum based oils.

Preferably the bridging oil is up to about 40% by weight of the particles. After the oil addition, there is continual mixing until there is substantial homogeneity. Typical mixing is for from about 2 minutes to about 15 minutes, preferably from about 3 minutes to about 10 minutes at mixing speeds of from 300 rpm to 900 rpm, with 300 rpm being satisfactory.

If desired to add additional surfactant, one may add a surfactant to the system such as nonionic surfactants, like Triton 100X ®. These nonionic surfactants are not necessarily needed if the oil is a coal-derived oil, but may be used if desired. Where a surfactant, that is a nonionic surfactant is used, it is used at a level of from about 1% by weight to about 5% by weight of the coal particles, preferably from about 1% by weight to about 3% by weight of the coal particles. An adequate surfactant can be derived by distillation of the phenol and creosol fractions from coal liquids and used in conjunction with the bottoms.

After mixing, particles will be agglomerated, typically in a ball mill. Agglomerating conditions are typical and merely involve blending of the materials together until the agglomerates are of uniform size. This may take from 5 to 30 minutes. Typically the agglomerates will have greater than 30 mesh size. The agglomerates screen to remove ash and water and are then air dried.

The agglomerates are deashed and dewatered and in testing are shown to have low mineral and low ash content.

The processes herein described of successful agglomeration of low cost lignite and subbituminous coal provides agglomerates which for the first time have potential significant commercial possibilities for low-rank coals. For example, these agglomerates represent products prepared from lowrank coal which have the following attributes: (1) lower transport costs (higher btu/lb) and potential slurry pipeline applications; (2) reduction in dust explosions and environmental pollution due to less fines; (3) higher recovery following crushing (fines can be agglomerated); (4) reduced pyrophoric properties resulting in safe transport and storage; (5) higher boiler capacity due to higher btu/lb; (6) less ash fouling of boiler (higher on line time and less maintenance costs, due to less ash and less sodium in the ash); (7) less ash handling and disposal at the utility site; and (8) lower sulfur emissions.

For coal conversion, there also are significant benefits. In particular, the following attributes are achieved: (1) less oxidation and loss of reactivity during preparation and storage; (2) decreased crushing costs due to a softening of the coal; (3) decreased drying costs due to rejection of moisture at ambient conditions; (4) decreased catalyst deactivation due to the elimination of ion exchangeable cations and lower hydrogen consumption due to less sulfur; (5) higher through put due to less ash and water in the feed; (6) a lower ash content resulting in lower liquid losses due to adsorption in a critical solvent deashing unit; and, (7) up-grading of previous coal conversion reject streams.

The following examples are offered to further illustrate but not limit the process of the present invention.

EXAMPLES

A successful study of a potential process to produce lowash and low-moisture content oil agglomerates from low-rank coals was carried out at the University of North Dakota Energy and Mineral Research Center. The tests were successful in agglomerating a lignite with additives and a coal-derived crude phenolic binding oil at ambient conditions. Up to three-fourths of coal ash and moisture was removed with coal recoveries of 90% as agglomerates. Repeat tests have yielded agglomerates with ash contents as low as 0.7 weight percent. Particle size of the agglomerates varies as a function of agglomerating conditions and has only a slight effect on ash content.

The tests used laboratory equipment operating at ambient conditions with micronized coal (100% minus 325 mesh), additives, coal-derived oil and water. The agglomerates were collected on 30 mesh screen, washed with deionized water, and air-dried at least overnight. Analysis of the agglomerates was on Thermogravimetric Analysis (TGA) equipment using a TGA Proximate Analysis methodology. To ensure the accuracy of the results, selected samples including the feed coal were analyzed using ASTM method D3172. Table 1 shows the proximate analysis of the feed coal as determined by both the TGA and the ASTM methods. Table 2 shows TGA and ASTM results for agglomerates obtained using three different sets of test conditions.

Table 3 summarizes the results of agglomeration tests carried out under three sets of experimental conditions with the Zap Indian Head lignite and coal-derived binding oil. Excellent ash reduction of 73% and moisture reduction of 77% was obtained at ambient conditions with simple equipment. The 92% coal recovery shown was not atypical of recoveries in the testing where Condition 2 was used. Reject did not collect on the screen but was recoverable as a fine coal. Ash and moisture reduction and coal recovery were equalled or improved with repeat testing.

TABLE 1

TGA AND ASTM PROXIMATE ANALYSES OF ZAP INDIAN HEAD LIGNITE

| | TGA[a] wt % | ASTM D3172 wt % | Difference % |
|---|---|---|---|
| Volatile Matter, mf | 45.51 | 45.16 | −0.8 |
| Fixed Carbon, mf | 46.39 | 46.66 | 0.6 |
| Ash, mf | 7.82 | 8.18 | 4.4 |
| Moisture, AR | 24.78 | 27.40 | 9.6 |

[a]Average of three analyses

TABLE 2

ASH REDUCTION AS MEASURED BY ASTM AND TGA METHODS

| | ASTM D3172 Results | | | TGA Results | | |
|---|---|---|---|---|---|---|
| Condition | 1 | 2 | 3 | 1 | 2 | 3 |
| Volatiles, mf | 59.58 | 64.54 | 63.12 | 59.71 | 64.02 | 62.83 |
| Fixed Carbon, mf | 36.04 | 34.17 | 34.53 | 36.11 | 33.89 | 34.37 |
| Ash, mf | 4.38 | 1.29 | 2.35 | 4.10 | 1.76 | 2.55 |
| Moisture, AR mf and oil free | 8.19 | 19.59 | 13.48 | 5.80 | 13.90 | 11.03 |

TABLE 2-continued

ASH REDUCTION AS MEASURED BY ASTM AND TGA METHODS

| | ASTM D3172 Results | | | TGA Results | | |
|---|---|---|---|---|---|---|
| Condition | 1 | 2 | 3 | 1 | 2 | 3 |
| Volatiles | 46.89 | 49.04 | 48.26 | 47.07 | 48.69 | 48.11 |
| Fixed Carbon | 47.59 | 49.53 | 48.80 | 47.77 | 49.17 | 48.65 |
| Ash | 5.53 | 1.43 | 2.94 | 5.16 | 2.14 | 3.24 |

TABLE 3

RESULTS OF OIL AGGLOMERATION OF ZAP INDIAN HEAD LIGNITE

| CONDITION | 4 | 2 | 5 | Reject[a] |
|---|---|---|---|---|
| Ash Reduction[b], % | 34.2 | 72.8 | 58.7 | 59.6 |
| Moisture Reduction, % | 76.6 | 43.9 | 55.5 | 73.8 |
| Coal Recovery, % | 74 | 92 | 79 | — |

[a]Reject was minus 595 micron material produced under test condition 2.
[b]Wt % on a moisture-free, oil-free basis.

The agglomeration of low-rank coal in this study was achieved at ambient conditions using very low speed blending and mixing. The binding oil was the unrefined crude phenol coal-derived material (90 GC area percent being phenol, creosols and xylenols, with no other component making up more than 1 GC area percent) is such that at present, it has only fuel value.

Agglomerates approximated spheres with diameters ranging from 1 to 25 mm; sizes were controlled by varying mixing time and component ratios. With extended mixing times, small agglomerates tended to aggregate, forming larger agglomerates. Larger agglomerates tended to have slightly higher ash and moisture contents, probably due to occlusion of dissolved salt during agglomerate growth.

In all cases, air drying at ambient temperature was used to remove moisture. It is apparent that little is accomplished by drying in excess of 24 hours at these conditions.

What is claimed is:

1. A method of producing low ash, low moisture coal agglomerates, comprising:

(a) size-reducing coal particles to a size that passes through a 60 mesh standard sieve screen;

(b) adjusting the pH of said particles to 5 or less with an acid which facilitates removal of cations from carboxylic acid salts with the mineral phase of said low moisture coal;

(c) mixing said size-reduced particles with from about 20% by weight to about 50% by weight of a coal tar unprocessed derived bridging oil; and (d) agglomerating the size reduced particles.

2. The method of claim 1 wherein the pH is adjusted to 3 or less.

3. The method of claim 1 wherein the amount of bridging oil is up to about 40% by weight of said coal particles.

4. The method of claim 1 wherein an additional step comprises air drying of said agglomerates.

5. The method of claim 3 wherein the bridging oil is a polar organic solvent which is at least partially water soluble and capable of entering the coal pore structure.

6. The method of claim 3 wherein the bridging oil has a predominate amount of phenol present.

7. The method of claim 3 wherein the bridging oil has a predominately amount of creosol present.

8. The method of claim 1 wherein the size reduction is to a micronized size.

9. The method of claim 8 wherein the micronized size is from about 10 microns to about 20 microns.

10. The process of claim 1 wherein the acid used for pH adjustment is selected from the group consisting of sulfuric acid, hydrochloric acid, nitric acid, and carbonic acid.

* * * * *